United States Patent [19]

Babor

[11] 3,962,880

[45] June 15, 1976

[54] COLUMNS FOR PLATFORMS, PIERS, CAUSEWAYS AND THE LIKE, AND METHOD OF ERECTING SAME

[76] Inventor: Rud J. Babor, N. Mountain Ave., Bound Brook, N.J. 08805

[22] Filed: Aug. 5, 1974

[21] Appl. No.: 494,705

[52] U.S. Cl. ..... 61/53.74; 61/52

[51] Int. Cl.[2] ..... E02D 7/24

[58] Field of Search ..... 61/34, 46, 46.5, 53.74, 61/82, 52

[56] References Cited

UNITED STATES PATENTS

| | | | |
|---|---|---|---|
| 2,475,888 | 7/1949 | Hackett | 61/46 |
| 3,054,268 | 9/1962 | Müller | 61/52 |
| 3,128,604 | 4/1964 | Sandberg | 61/46.5 |
| 3,389,562 | 6/1968 | Mott et al. | 61/46.5 |

*Primary Examiner*—Paul R. Gilliam
*Assistant Examiner*—David H. Corbin
*Attorney, Agent, or Firm*—Shlesinger, Fitzsimmons & Shlesinger

[57] ABSTRACT

Hollow casings containing a plurality of vertical compartments are towed or floated to an erection site where they are filled with concrete or removable pillar members to form respectively, permanent or temporary columns for supporting drill platforms, piers, etc. First chains or weights are placed in one compartment of a casing to erect it without flooding, and then concrete or removable pillar sections are placed in a second compartment while compressed air is supplied through a third compartment underneath the casing to blow the sand on the bottom of the body of water away to permit the casing to embed itself in the floor of the body of water. Additional concrete or chains, for permanent and temporary columns, respectively, may be added to the several compartments, including that which contained the compressed air line, usually after the removal of the line therefrom, to anchor the column firmly in place.

6 Claims, 7 Drawing Figures

COLUMNS FOR PLATFORMS, PIERS, CAUSEWAYS AND THE LIKE, AND METHOD OF ERECTING SAME

The present invention relates to piers, rigs for drilling equipment, and supports for bridges and causeways above bodies of water, and the like, and more particularly to the construction and placing of columns or pillars for supporting platforms, or devices intended to be supported, above water. More specifically the invention deals with the erection of columns, or pillars, or foundation piers made of reinforced concrete or of steel, or of any other suitable material.

A primary object of the invention is to provide a supporting column, or pillar, which can be floated to the location where it is to be used, and then erected.

Another object of the invention is to provide a shell or casing, that will serve as a supporting column or pillar and that can be floated to a construction site and placed in an erect position without flooding, by the use of ballast chain.

Another object of the invention is to provide a shell or casing for the purpose described which can be embedded in the bottom of a body of water either as a permanent or as a temporary installation.

Still another object of the invention is to provide a shell or casing of the type described disposed to house removable girders or pillars which divide the casing into vertical chambers and that can be made in sections separable either, or both, vertically or horizontally, and which are locked in position inside the casing by wedging or anchoring with removable chains.

Other objects of the invention will be apparent hereinafter from the specification and from the recital of the appended claims, particularly when read in conjunction with the accompanying drawings.

Several different embodiments of the invention have been illustrated in these drawings, in which.

Figure 1:
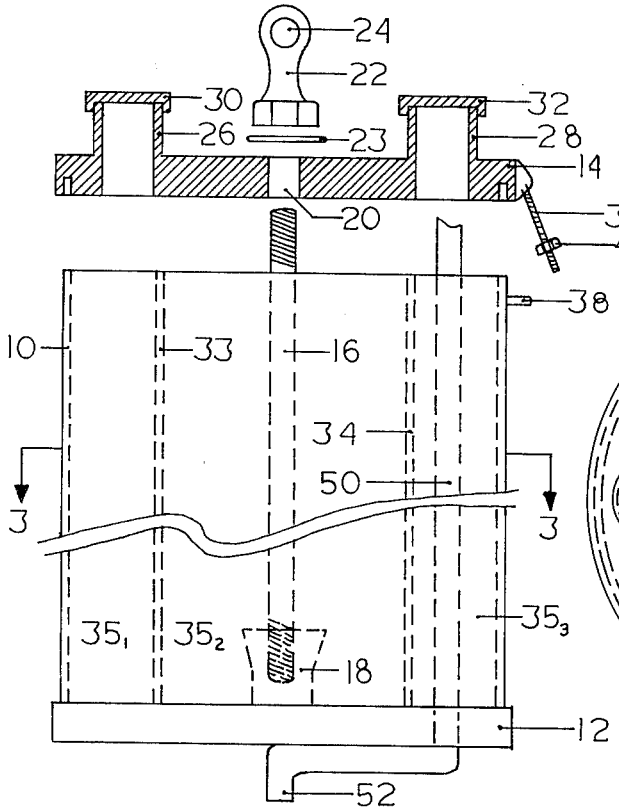
FIG. 1 is a part elevational, part sectional, part exploded view of an empty shell or casing used in constructing a column made according to one embodiment of this invention.
Figure 2:
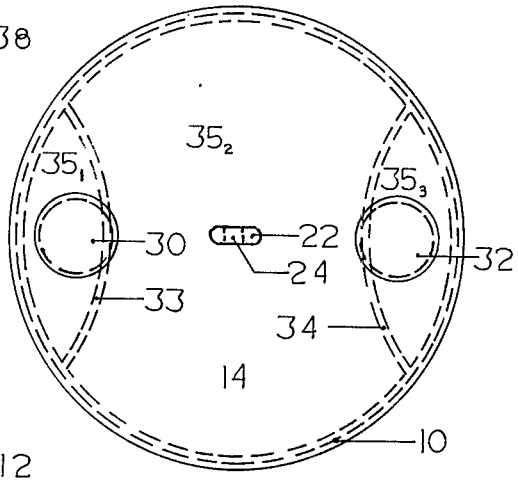
FIG. 2 is a top plan view of this empty shell or casing.
Figure 4:
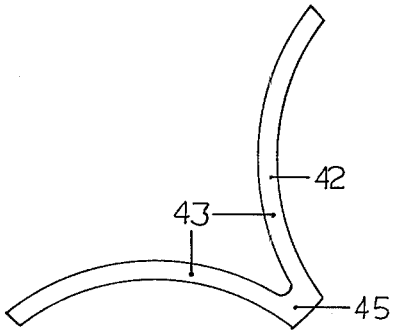
FIG. 4 is a plan view of one of the two members that make up this split girder or pillar that is placed in casing to form the column shown in FIG. 3.

Referring now to the drawings by numerals of reference, and first to FIGS. 1 and 4 inclusive, 10 denotes a hollow casing, which may be made of steel or other suitable material, and which is sealed closed at its bottom permanently by an end cap 12, such as, for example, a steel plate welded or otherwise fixed to the casing. The top of the casing is closed by a removable end cap 14, which is secured in position by an elongate bolt 16 that threads at its lower end into a socket member 18 which is integral with or permanently secured to the bottom cap 12. The bolt 16 is threaded at its upper end also, to extend through the hole 20 in the top cap 14 and have threaded on to it the tow nut 22. Nut 22 has an aperature 24 through it, which may receive a hook to permit towing the casing to the location at which it is to be used. A washer 23 is interposed between the nut 22 and the end cap 14.

Integral with the top cap 14 and projecting upwardly therefrom are two tubular portions 26 and 28, which are closed by small caps 30 and 32, respectively. Fixed within casing 10 are two arcuate partitions 33 and 34 the vertical side edges of which are welded or otherwise secured to the inner surface of casing 10 to divide the casing into three separate chambers $35_1$, $35_2$and $35_3$.

The end cap 14 may be secured in place by a plurality of swing or toggle bolts 36, of which only one is shown, which are fastened to the end cap, and which engage in slotted lugs 38 that are fastened to the casing 10. Nuts 40 on the bolts engage under the lugs to secure the end cap in position.

Mounted in the chamber $35_3$ is a conduit 50 for compressed air. This conduit is closed, when the device is in use, by the cap 32. It projects through the end cap 12 and has a right angular extension 52 which extends beneath the bottom of end cap 12 and serves to assist in embedding the casing in the sandy bottom at the site where the casing is to be used, as will be described further hereinafter.

For use as a permanent installation, the casing 10 is towed, for instance by engaging a tow hook in the eye 24 of nut 22, to the site where the column is to be located. At this site, the casing 10 may be lifted by a crane, for example, slightly from the generally horizontal position which it has occupied while being towed through the water, and chains may be dropped as ballast into the chamber $35_1$ and/or $35_3$ to erect the casing and to cause its lower end to become partially embedded in the sea, lake, or stream bottom. Then with the cap 32 removed, a compressed air line is hooked up to conduit 50, and concrete may then be poured into the chamber $35_2$ of the casing. The compressed air flowing out of duct 52 beneath the erected column blows the sand on the bottom of the body of water from beneath the bottom of the casing allowing it firmly to embed itself in the bottom of the body of water as the concentrate fills chamber $35_2$. Thereafter the chains and compressed air duct may be removed from chambers $35_1$ and $35_3$ and these vacated chambers may be filled with concrete.

Figure 3:
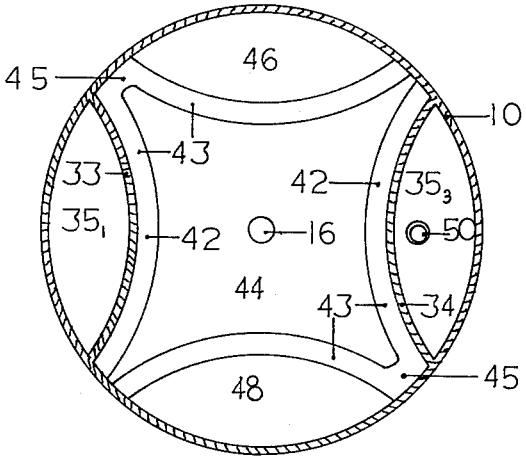
FIG. 3 is a sectional view through the shell or casing taken on line 3—3 of FIG. 1 looking in the direction of the arrows, but showing a split girder or pillar positioned inside the casing to form a column made according to another embodiment of this invention.

For temporary installations, where the column structure will later be dismantled and the components reassembled at another site, sectionalized or split girders or pillars of the type shown in the embodiments of FIGS. 3 and 4 may be employed in casing 10 instead of concrete. Here, two vertically disposed, generally V-shaped members 42 are mounted in chamber $35_2$ to form therein a split girder or pillar. Each member 42 comprises two arcuate sections 43 secured together along a seam 45 that is curved to conform to the inner surface of casing 10. Also, the concave surfaces of sections 43 conform to the convex surfaces of the partitions 33 and 34, so that opposed sections 43 rest against the confronting surfaces of partitions 33 and 34, whereby chamber $35_2$ is operatively divided into three chambers 44, 46 and 48 (FIG. 3).

After the casing has been uprighted and the split pillar 42, 42 has been removably inserted therein, anchoring or wedging chains may be inserted into chamber 44 to force members 42 apart and against partitions 33 and 34. The sheer weight of the structure, including the casing 10, the uprighting chains in chambers $35_1$ and $35_3$, the split pillar members 42 and the wedging chains, together with the aid of compressed air discharged through duct 50, will cause this structure to embed itself firmly in the bottom of a body of water.

If desired each member 42 may be made in like, vertical sections stacked in the casing one on the other, or in some cases, it may be desireable to make them in one piece. Moreover, the casing or shell 10 need not be round. It can be square, pentagonal, octagonal or any other desired or suitable shape in cross section. Its transverse dimension will be determined by the total weight it will be expected to support and by what portion of its height is to be embedded in the bottom of the water, what portion of its height is to remain in the water, and how much of its height is to protrude above the surface of the water.

Figure 5:
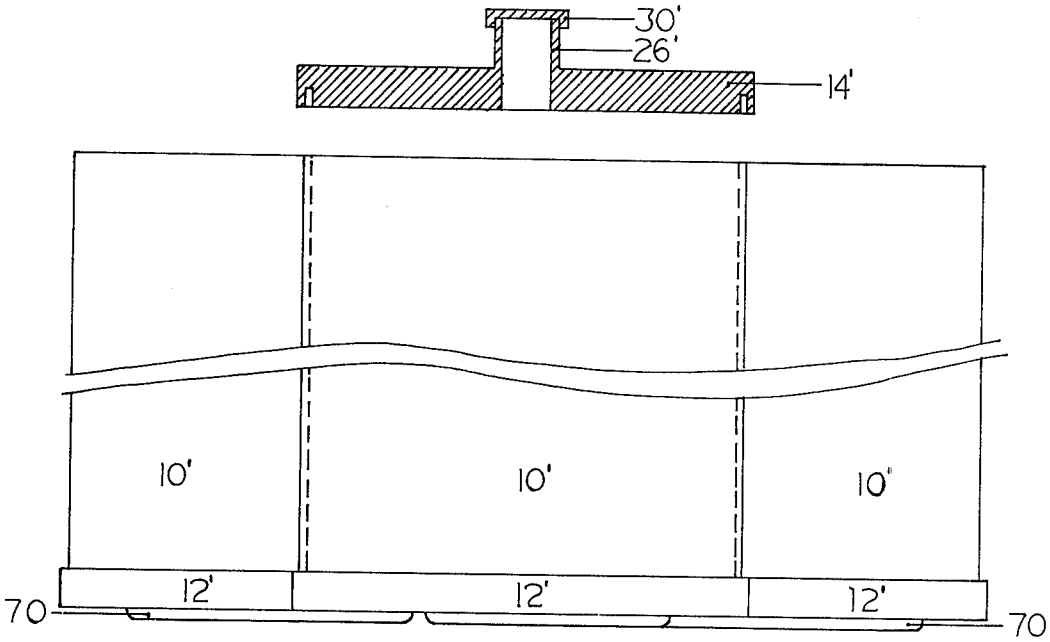
FIG. 5 is a fragmentary elevational view, partly exploded, of an embodiment of the invention employing a plurality of casings welded to one another.
Figure 6:
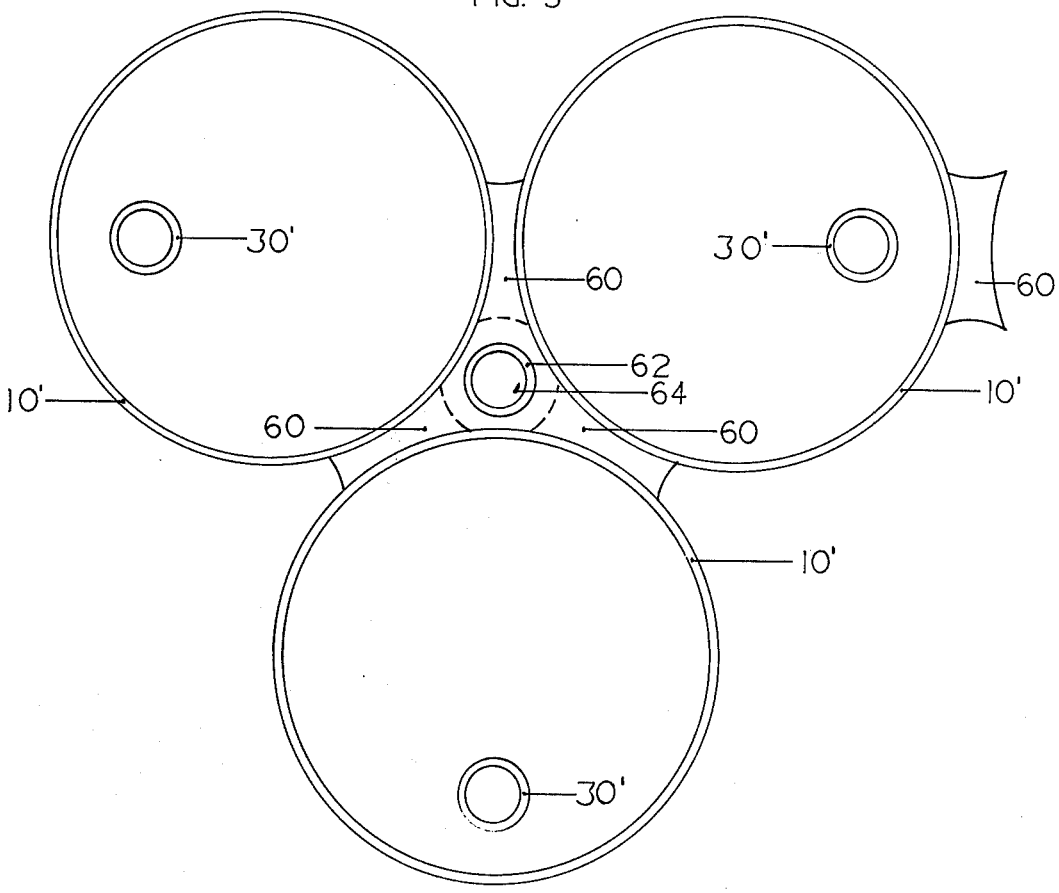
FIG. 6 is a top plan view of this construction.
Figure 7:
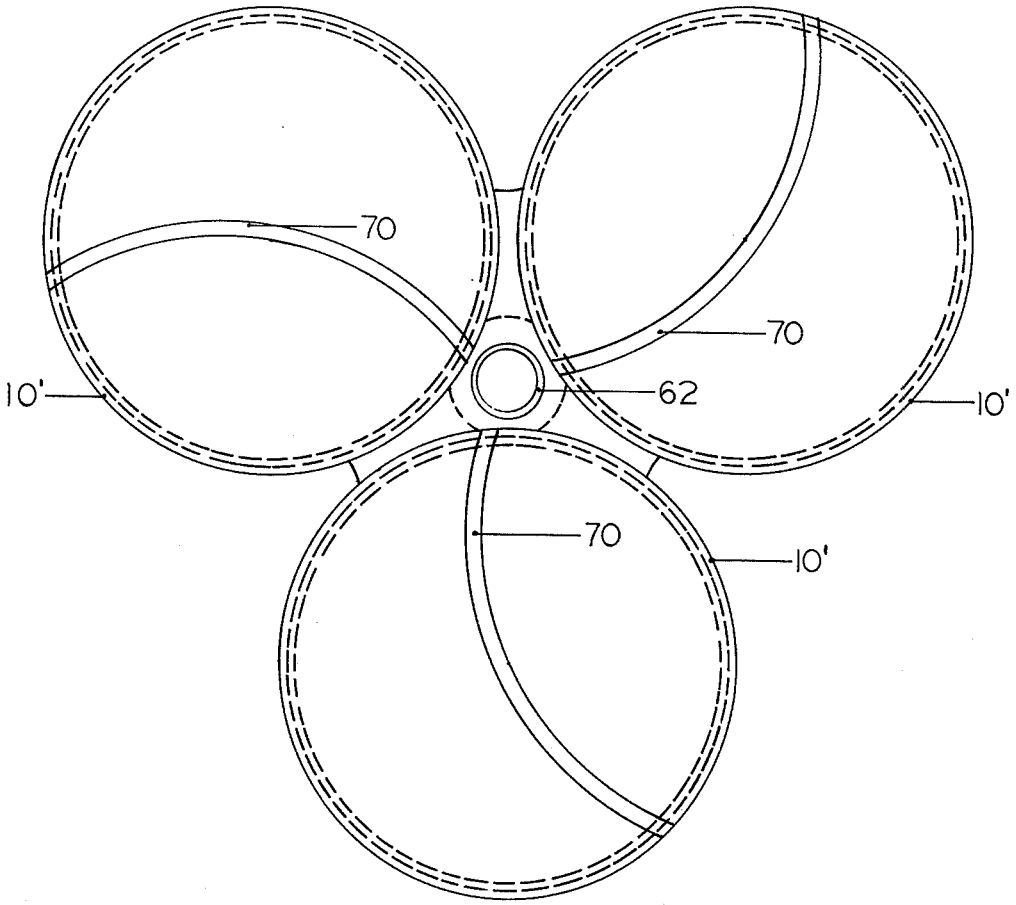
FIG. 7 is a bottom plan view of this construction.

FIGS. 1 to 4 inclusive show how a single column of this type might be constructed and used, for instance, for supporting a warning or guiding light, or which may be used in multiples for supporting a dock or drilling platform, etc. In FIGS. 5, 6, and 7 a plurality of generally similar casing 10' are shown connected together by blocks 60 which are welded between and to adjacent casings. A single compressed air conduit 62, which is closed at its upper end by a removable cap 64 is provided between the three casings in the instance shown in FIGS. 5 and 6. This conduit can be closed at its upper end by the cap 64. The casings 10' of the multiple unit shown in FIGS. 5 and 6 are closed at their lower ends by end caps 12', similar to the cap 12 described with reference to the FIG. 1, and at their upper ends by removable end caps 14', such as that shown in FIG. 1 at 14. Caps 14' have inlets 26' closed by caps 30'. However, in the columns 10', the section, which is designated at $35_3$ in FIG. 3, and which encloses the compressed air pipe 50 in that figure, can be omitted in the cluster arrangement of FIGS. 5 and 6, or can be used to hold concrete when the column or pillar is in place.

Integral with or secured to the bottom caps 12' of the embodiment shown in FIGS. 5 and 6 and projecting from the bottom thereof, as shown in FIGS. 5 and 7 are arcuate fins 70 that dig better into the sand on the bottom of the body of water in which the casings are to be located, and thereby more securely hold the casings in place when compressed air is emitted from the pipeline 62.

The number of columns or pillars in a cluster can be multiplied indefinitely, since blocks 60, as shown at the right in FIG. 6, can be welded to each of the individual columns or pillars for securing thereto additional columns or pillars.

For use, the cluster of casings 10' is hauled to the site where they are to be anchored by, for instance, a hook and chain connected to the eye of nut 22. When the site is reached where the columns are to be located, the casings can be raised a little, say at an angle of 15°, the cap 30 can be removed, and chains or weights can be dropped into the chambers $35_1$ to erect the casings. Then, concrete or split pillars can be placed into the several central chambers of the casings to anchor them firmly in place. During this operation compressed air is supplied to the duct 62 to pass through the duct to the undersides of the casings. Further chains or concrete can then be placed in the other compartments of the casings; and the added weight plus the compressed air will cause the loaded casings 10' to bury themselves into the bottom of the water. As additional weight is added, the compressed air supply is increased and maintained until the desired depth of embedding of the resultant column is achieved.

In other words, the casing or casings can be floated to a site and erected in a manner like a coffer dam. The caps on the two ends of the casings keep them air tight so that they will readily float, as they are hauled to the site at which they are to be erected. Of course, however, if desired, the casings may be rafted or otherwise hauled to their desired location. The necessary chains, concrete and/or split pillars 42, 42 may be shipped with the casings 10, 10', but are not installed until the casings are to be erected.

In permanent installations the ballast chains or weights may be removed, as well as the air duct, after the casings have been satisfactorily anchored, as by filling the center chamber and then all remaining compartments may be filled with reinforced concrete. In retrievable or temporary installations, the ballast chains or locking chains may be removed to dismantle a previously erected column. Also, weights may be fastened at intervals to the chains to speed the addition of weight during erection and to permit the chains to wedge without fouling.

Vibrators may be used while the columns are being embedded, and also while temporary columns are being made buoyant at the time of dismantling. The temporary columns are dismantled by reversing the order of the steps in their installation.

In permanent installations, whether using individual casings or clusters of casings, the compressed air compartment will be the last one to be filled with concrete because air pressure is maintained under the bottom of the shell for embedding purposes until the maximum pressure of sheer weight has been exerted and the column is solidly embedded in the floor of the body of water. The central chamber $35_2$ is ordinarily filled with concrete at the erection site while ordinarily ballasting chain is dropped into the chambers 35, and or $35_3$ to permit the shell to be erected; and the chain remains in this chamber at least until the central chamber $35_2$ has been filled with concrete and the column has been embedded in the floor of the body of water, after which the chains and air duct are removed and the remainder of the casing is filled with concrete.

The invention may be employed for various installations, such as causeways, off-shore berths, bridge foundations, piers, jetties, loading or unloading islands, coffer dams, drilling platforms, channel markers, buoys, range lights, moorings, and even for land uses such as at industrial sites, shore-line protectors, etc.

The pillars or columns, particularly for temporary use, can be sectionalized vertically and/or horizontally. The sections must lock or nest into each other vertically and retain their positions through use of locking chains (as distinguised from ballast chains), which may be fastened to the sections to lower same into the passing, and to remove the sections when the column is later dismantled. Also each locking chain is anchored or cabled in the vicinity of the top of the casing 10 or 10' to permit removal thereof upon dismantling. All chains should be fastened in some manner to the top of the casing to allow their removal.

In multicell units, the compartments or cells, which at the time of raising the shells to vertical position had been filled with ballast chains, may be filled with additional locking chain. All chains may be tied or anchored near the tops of the columns to be accessible for dismantling.

The shells, of course, will be constructed on shore, and launched either by a marine railway or skidded down ways or ramps into navigable water.

While the invention has been described in connecton with different embodiments thereof, it will be understood that it is capable of further modification, and use, and that this application is intended to cover any embodiments of the invention which come within the scope of the invention or the limits of the appended claims.

Having thus described my invention, what I claim is:

1. The method of constructing a supporting column in a body of water, which comprises forming a hollow, water-tight shell closed at its lower end, and having therein a plurality of vertically extending compartments each of which extends without interruption between opposite ends of the shell, moving the shell to the site where it is to be erected in water, raising the shell to a vertical position in the water by inserting solid, removable weights through its upper end into one of said compartments, while maintaining the lower ends of said compartments sealed thereby to prevent water from said body thereof from entering said shell, further weighting the shell, while preventing the flooding of any of said compartments, to embed said one end of the shell firmly in the floor beneath the body of water, and applying a stream of compressed air beneath said one end of the shell during said further weighting thereof, to blow away sand on said floor from beneath the shell to allow the shell to embed itself further in said floor, and closing the upper end of the shell with a removable cover after it has been embedded firmly in place, thereby to prevent any water from entering said compartments.

2. The method according to claim 1, wherein a removable reinforcing member is placed in another of said compartments after the shell has been raised to vertical position further to embed the shell into said floor.

3. The method according to claim 1, wherein concrete is poured into another of said compartments after the shell has been raised to vertical position, and the supply of the air stream is continued while the concrete is being poured.

4. A supporting column for use in a body of water, comprising a hollow casing having a central bore closed at one end, and adapted to have said one end embedded in the bottom of a body of water, at least two spaced partitions each of which extends though and divides said central bore into at least three vertical compartments, each of which extends without interruption between said opposite ends, a first end cap fixedly secured across one end of said casing and operatively closing said one end of said bore, a further end cap removably secured over the opposite end of said casing releasably to close the opposite end of said bore, a duct carried by said casing and extending under said first end cap supplying compressed air beneath said casing, one of said compartments being disposed centrally of said casing, and a rigid pillar removably mounted in, and extending between opposite ends of said one compartment, and said duct having a vertical portion extending through another of said compartments and a horizontal portion extending beneath said first end cap.

5. A supporting column as claimed in claim 4, wherein said pillar comprises a pair of vertically disposed members in said casing, and said members have spaced, confronting surfaces between which weights are disposed to be inserted, when said casing is positioned vertically, thereby to urge said members away from each other and against the wall of said centrally disposed compartment.

6. A supporting column as claimed in claim 5, wherein said two spaced partitions divide said casing into said central compartment and two side compartments at opposite sides of the central compartment, and said members are positioned to have portions thereof engage said said partitions, and other portions thereof engage the inside wall of said casing.

* * * * *